United States Patent [19]

Dierbeck

[11] Patent Number: 4,981,170

[45] Date of Patent: Jan. 1, 1991

[54] HEAT EXCHANGER WITH STATIONARY TURBULATORS

[76] Inventor: Robert F. Dierbeck, 2707 Hall Rd., Hartford, Wis. 53027

[21] Appl. No.: 443,218

[22] Filed: Nov. 29, 1989

[51] Int. Cl.[5] ..... F28F 13/12; F28F 9/12; F16L 37/26

[52] U.S. Cl. ..... 165/109.1; 165/174; 285/325

[58] Field of Search ..... 165/109.1, 174; 285/325, 326, 19, 31

[56] References Cited

U.S. PATENT DOCUMENTS

| | | | |
|---|---|---|---|
| 1,291,849 | 1/1919 | Griffiths | 285/325 |
| 1,816,159 | 7/1931 | Smith | 165/174 |
| 2,030,734 | 2/1936 | Baird | 165/109.1 |
| 2,243,605 | 5/1941 | Richardson | 285/325 |
| 2,870,863 | 1/1959 | Bramhall | 285/325 |
| 3,099,315 | 7/1963 | Loehr | 165/109.1 |
| 4,216,825 | 8/1980 | Sumitomo | 165/109.1 |
| 4,347,897 | 9/1982 | Sumitomo et al. | 165/167 |
| 4,679,991 | 7/1987 | Harbison et al. | 285/325 |
| 4,702,274 | 10/1987 | Kramer | 285/325 |

FOREIGN PATENT DOCUMENTS

| | | | |
|---|---|---|---|
| 82555 | 3/1920 | Austria | 165/118 |
| 132460 | 4/1901 | Fed. Rep. of Germany | 165/118 |
| 358005 | 1/1906 | France | 165/150 |
| 581817 | 12/1924 | France | 165/90 |
| 636646 | 4/1928 | France | 165/35 |
| 673524 | 1/1930 | France | 165/76 |
| 8391 | 3/1903 | United Kingdom | 165/174 |

*Primary Examiner*—John Rivell
*Assistant Examiner*—L. R. Leo
*Attorney, Agent, or Firm*—Andrus, Sceales, Starke & Sawall

[57] ABSTRACT

A heat exchanger for various kinds of liquid and gaseous fluids includes a tubular conduit having a corrugated heat exchanging outer wall and a stationary baffle and turbulator plate mounted inside each corrugation. The turbulator plates divert the fluid flow radially into contact with the large surface areas of the corrugations and a ribbed construction on each turbulence plate adds to the turbulance of the fluid flow to enhance heat exchange. An assembly of tubular conduits is provided with quick disconnect attachments whereby individual conduits may be easily removed and replaced.

10 Claims, 3 Drawing Sheets

HEAT EXCHANGER WITH STATIONARY TURBULATORS

BACKGROUND OF THE INVENTION

The present invention pertains to heat exchangers for flowing fluid materials and, more particularly, to a heat exchanger of a corrugated tubular construction in which a stationary turbulator plate is disposed within each corrugation to improve the heat exchanging contact between the fluid and the walls of the conduit.

The prior art discloses the use of heat exchangers in which the tubular outer wall of the conduit containing the fluid flow is corrugated. Typically, each of the corrugations is provided with an interior baffle plate which blocks direct flow of the fluid through the conduit and causes the fluid to be diverted from a purely axial flow. The diversion of fluid flow by the baffle plate slows the flow through the conduit somewhat and enhances the heat exchanging contact between the fluid and the walls of the conduit, the surface area of which is substantially enhanced by the corrugated construction.

U.S. Pat No. 3,099,315 shows a heat exchanger including a corrugated main tubular conduit in which each corrugation comprises a pair of concave disks attached at their outer peripheral edges to define a corrugation with an open interior and opposite axial openings for the flow of a fluid therethrough. An interior baffle plate is enclosed in each corrugation and is provided with radially offset aperatures to allow fluid to flow from one side of the baffle plate to the other after it is diverted from a purely axial direction. Each baffle plate also includes a series of stationary vanes which serve to direct the axial flow of fluid into the corrugation radially outwardly to the holes in the baffle plate. Apart from the upstanding vanes, the interior surfaces of the corrugations and baffle plates are essentially smooth and uninterrupted.

U.S. Pat. No. 2,030,734 discloses a heat exchanger for a furnace which includes a series of axially connected heat exchanging chambers of annular construction, each of which encloses a baffle plate disposed to block direct axial flow and having an opening around its radial outer edge to direct the axial flow into the corrugation from the center radially outwardly around the outer edge, and then back to the center of corrugation on the opposite side of the baffle to exit axially therefrom. A series of stationary vanes is used to attach each side of the baffle plate to the inside walls of the annular chamber and to impart a swirling movement to the air flowing through the chamber.

British Patent No. 2,354 shows a heat exchanger with annular chambers similar to those described in the foregoing patent. Each chamber includes a baffle plate which is attached between the outer walls of the annular chamber and has holes for the flow of fluid therethrough which are radially displaced from the axis of the heat exchanger. The interior heat exchanging surfaces of the annular chambers are generally smooth and uninterrupted.

U.S. Pat. No. 4,561,494 shows an oil cooling heat exchanger comprising a series of axially aligned heat exchanging units also defining a generally corrugated construction. Each unit comprises a pair of outer dish-shaped plates which enclose a double layer internal baffle plate, each of which baffle plates is provided with stamped strands displaced from the surface of the baffle plate to space the same from the interior walls of the unit in which it is disposed, to provide contact surfaces for brazing the baffle plates in position, and to create turbulence in the oil flowing therethrough. The entire structure is intended to be enclosed in an outer housing through which a coolant, such as from an engine cooling system, is circulated to remove heat from the oil.

In order to optimize the heat exchanging characteristics of a heat exchanger utilizing stationary turbulator/-baffle plates, it is important to maximize the heat exchanging surface area within the allowable volume provided for the unit and to create adequate turbulence in the flow to further enhance heat exchanging contact between the fluid and the heat exchanging surfaces. In addition, where the heat exchange is enhanced by the flow of a second fluid across the outside surface of the conduit through which the primary flow of the fluid occurs, it is also desirable to increase the heat exchanging surface area and to additionally provide for turbulence in the flow of secondary fluid.

SUMMARY OF THE INVENTION

In accordance with the present invention, a heat exchanger for a flowing fluid is provided with a stationary turbulator that provides enhanced heat exchanging surface area, imparts added turbulence to the flow of fluid and is of relatively simple construction. The heat exchanger may be used for both liquid and gaseous fluids and is particularly adaptable for automotive use. The heat exchanger may be utilized with any of the several fluids for which cooling in an automotive application may be necessary or desirable, including engine coolant, oil and air.

In accordance with the preferred embodiment of the invention, the heat exchanger includes a tubular conduit which has a corrugated wall extending between a fluid inlet and a fluid outlet. The corrugated wall includes a series of generally parallel, axially spaced corrugations, each of which comprises a pair of opposed dish-shaped wall sections which are joined at their outer edges. Each of the dish-shaped sections also includes a central opening defined by inner edge portions and lying on the axis of the tubular conduit. Each of the inner edge portions is joined to the similar edge portion of the wall section of an adjacent corrugation to provide the continuous corrugated tubular conduit. The surfaces of the wall sections of each corrugation diverge radially inwardly from their joined outer edges to the separate central openings therein. A turbulator plate is mounted within each corrugation and is positioned between the central openings on opposite ends of the corrugation to block direct flow of fluid therethrough. Each turbulator plate has an outer peripheral edge which is spaced radially inwardly from the outer edge of the corrugation to define a peripheral fluid flow passage through which the fluid is diverted in a circuitous path around the turbulator plate. Each turbulator plate includes a series of ribs formed therein generally normal to the direction of fluid flow over the plate. Each corrugation is also provided with positioning means to maintain spacing between each turbulator plate and the adjacent surfaces of the wall sections comprising the corrugation within which the plate is disposed. The positioning means also holds the plate in position within the corrugation.

The walls forming the corrugations are preferably provided with a plurality of outwardly extending protrusions to increase the heat exchanging surface area on both the inside and the outside of each corrugation, and to increase the turbulence in the flow of the primary fluid on the inside of the heat exchanger as well as the turbulence in the flow of any secondary fluid caused to flow across the exterior of the heat exchanger to enhance the heat exchanging capability. The protrusions are preferably positioned generally parallel to one another and normal to the direction of the secondary fluid flow across the exterior of the heat exchanger unit.

The surfaces of the wall sections of each corrugation may also be provided with a plurality of inwardly extending protrusions which may be dimensioned to extend into contact with the interior turbulator plate to maintain the spacing thereof within the corrugation and to hold the plate in position. Preferably, the inwardly extending protrusions extend into direct contact with the ribs in the turbulator plate. The contacting surfaces of the inwardly extending protrusions and the turbulator ribs may be directly attached, as by welding, brazing, adhesives, or the like.

In the preferred embodiment of the invention, the ribs in the turbulator plate extend axially in both directions from the plane of the plate. Portions of the turbulator ribs adjacent the opposed surfaces of the wall sections of each corrugation may be upset and dimensioned to extend into contact with the wall sections to provide the positioning and securement of the turbulator plate within the corrugation.

The preferred construction of the present invention includes ribs in the turbulator plate which extend continuously along the surface thereof and comprise an array of ribs disposed in a concentric pattern extending radially from the outer periphal edge of the plate to the region of the plate adjacent the central openings in the wall sections defining each corrugation. Preferably, the array of concentric ribs is generally wave-shaped in cross section to define a wave of increasing amplitude in a radial inward direction corresponding to the radially inward divergence of the wall sections of each corrugation. The wall sections are preferably identical and each comprises a cylindrical outer flange adapted to be joined at its edge to the edge of the outer flange of the adjacent opposed wall section. Correspondingly, the inner edge of each wall section preferably comprises a cylindrical inner flange which is joined to the like inner flange of the wall section of an adjacent corrugation. The joined inner flanges of each adjacent pairs of wall sections also define the common central opening of adjoining corrugations.

In the presently preferred embodiment particularly adaptable for use in automotive applications, the corrugations and interior turbulator plates are generally rectangular in shape to optimize the amount of heat exchanging surface area for a given volume of space. The outwardly extending protrusions on the walls of the corrugations are preferably positioned generally perpendicular to the longer edges of the rectangular corrugations and also perpendicular to the direction of flow of the secondary fluid (e.g. cooling air) caused to flow over the exterior of the heat exchanger. Along with the generally rectangular configuration, the central openings between adjacent corrugations are also elongated in the direction of the longer edges of the rectangular corrugations.

DETAILED DESCRIPTION OF THE PREFERRED EMBODIMENT

Figure 1:
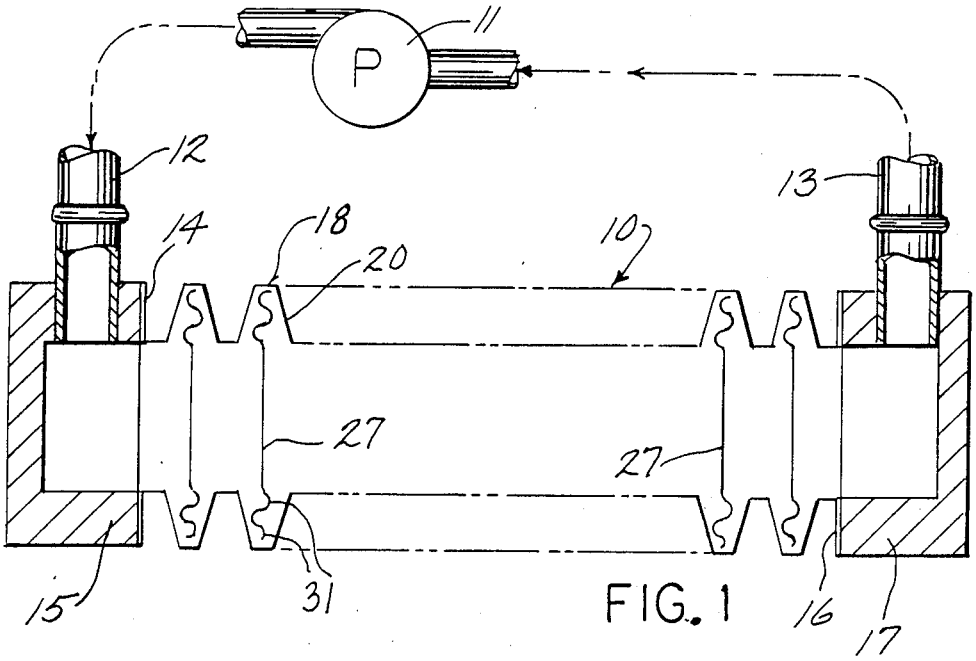
FIG. 1 is a partial axial cross section through the heat exchanger of the present invention and additionally showing its connection to a pump for circulating the flow of a fluid therethrough.

Referring to FIG. 1, a heat exchanger 10 of the present invention is shown operatively attached to a pump 11 which causes a fluid to flow into the inlet 12 of the heat exchanger and to exit therefrom through an outlet 13 for return to the pump. The pump, for example, may comprise the water pump on an internal combustion engine. However, the heat exchanger to be described in more detail hereinafter is also suited for cooling other fluids such as engine oil or engine combustion air, as well as for cooling or heating a variety of other fluids for entirely different applications.

Figure 2:
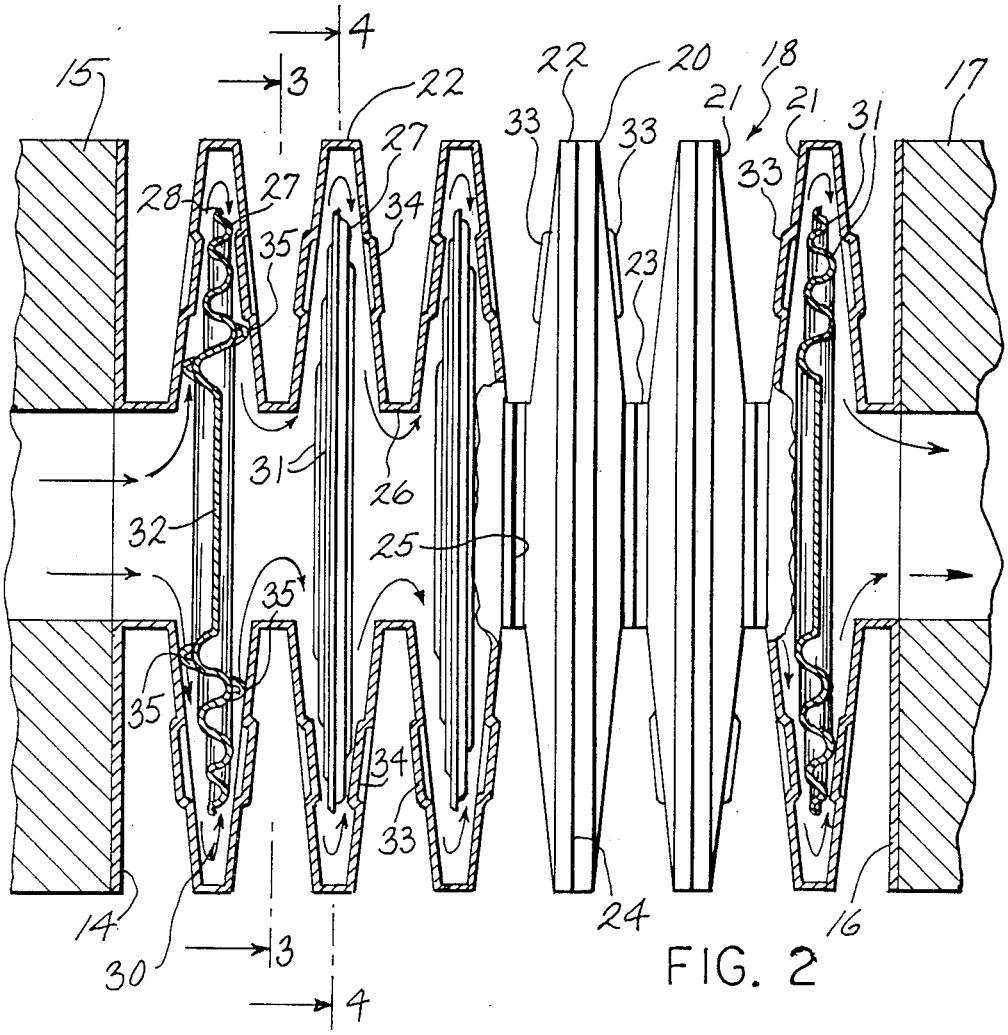
FIG. 2 is an enlarged partial axial section through the heat exchanger shown in FIG. 1.
Figure 3:
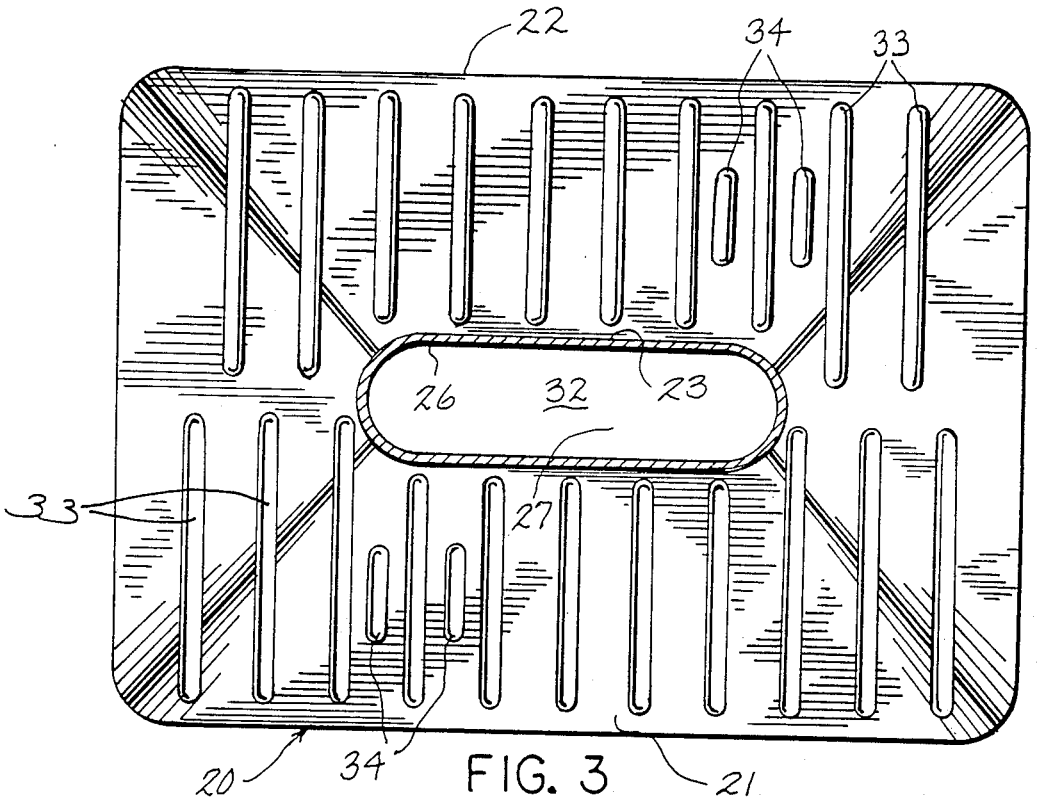
FIG. 3 is a section through the heat exchanger taken on line 3—3 of FIG. 2.
Figure 4:
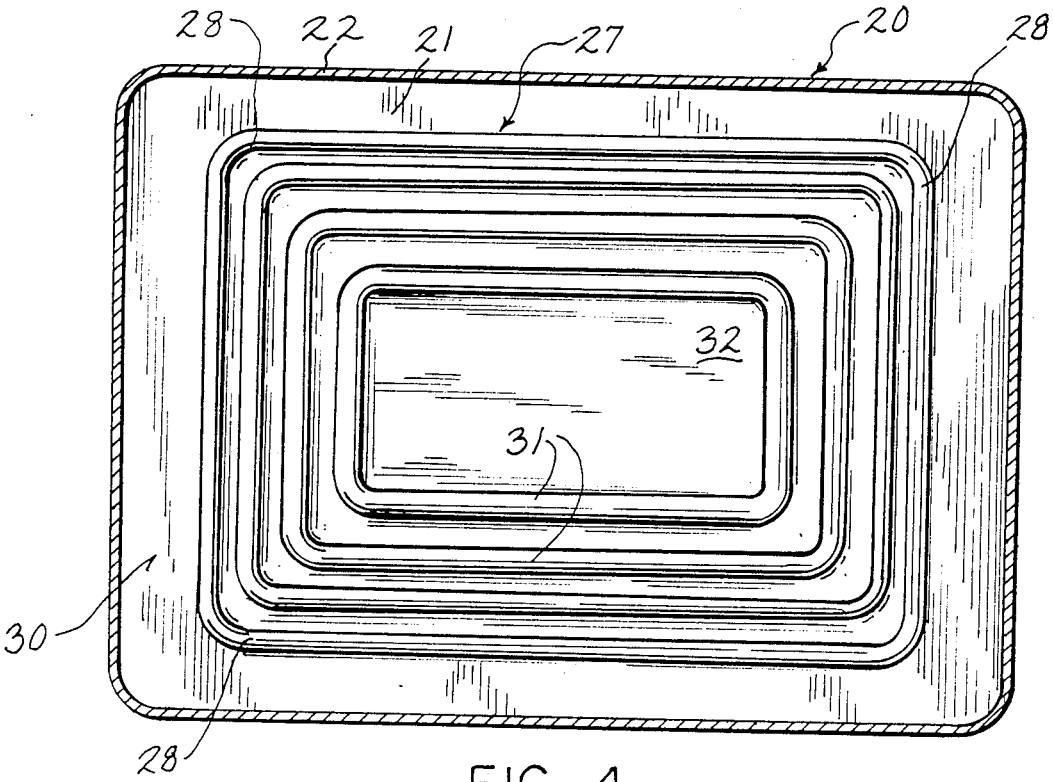
FIG. 4 is a section through the heat exchanger taken on line 4—4 of FIG. 2.

The heat exchanger includes a tubular conduit 18 which has an inlet flange 14 on one end for attachment to an inlet header 15 and an outlet flange 16 on the opposite end for attachment to an outlet header 17. The tubular conduit 18 comprises a series of generally parallel and axially spaced corrugations 20, each of which is identical. Referring also to FIGS. 2, 3 and 4, each corrugation 20 is formed from a pair of identical dish-shaped wall sections 21, each wall section including an outer flange 22 and an inner flange 23. The outer and inner flanges of each wall section extend in opposite axial directions and, to form a corrugation 20, a pair of opposed wall sections 21 are joined at the edges of their outer flanges 22 with a continuous outer seam 24. Similarly, adjacent corrugations 20 comprising the tubular conduit 18 are connected by joining the edges of adjacent inner flanges 23 with a continuous inner seam 25. The seams 24 and 25 may be provided by welding, brazing, soldering, or even gluing in any manner which will provide a leak-tight seal of requisite strength.

The inner flanges 23 join adjacent corrugations 20 and also provide central openings 26 for the flow of fluid from one corrugation to the next and thus, through the heat exchanger. In the presently preferred construction and referring particularly to FIG. 3, the corrugations 20 are of a generally rectangular shape, as viewed in a plane normal to the axis of the heat exchanger. The surfaces of the wall sections 21 of each corrugation diverge radially inwardly such that each corrugation is narrowest at its peripheral outer edge, defined by the outer flanges 22, and widest at its inner edge, defined by the inner flanges 23.

Within each hollow corrugation 20 there is mounted a baffle or turbulator plate 27. Each turbulator plate comprises a solid sheet having a shape generally the same as the corrugation, namely, rectangular in the preferred embodiment shown in FIG. 3. Because of the solid construction of the turbulator plate 27, it poses a barrier to the direct flow of fluid through a corrugation from one central opening 26 to the other. However, the turbulator plate is somewhat smaller than the corrugation such that its outer peripheral edge 28 is spaced radially inwardly from the attached outer flanges 22 of the corrugation to define a peripheral fluid flow passage 30 therebetween. Thus, the fluid flowing into a corrugation from an adjacent upstream corrugation (or from the inlet header 15) will be diverted radially outwardly by the solid turbulator plate 27, flow around the outer peripheral edge 28 and through the fluid flow passage 30 and radially inwardly to the downstream central opening 26. This provides the general function of a typical baffle plate to slow somewhat the flow of fluid and to assure its enhanced contact with a larger heat exchanging surface area.

To further enhance the heat exchanging capability, each of the turbulator plates 27 is provided with a series of turbulator ribs 31 which extend generally normal to the direction of radial fluid flow over the plate, as just described. The ribs 31 thus provide at least a partial barrier to the fluid flow and surface irregularities which cause turbulence and mixing of the fluid to further enhance heat exchanging contact with the walls of the corrugations. The turbulator ribs are formed in and extend from both sides of the turbulator plate 27 to present similar ribbed surfaces on both sides. Preferably, the ribs extend continuously along and around the entire surface of the plate and, in the preferred rectangular configuration, comprise a concentric array of rectangular ribs that extend radially from the outer peripheral edge 28 to the portion of the plate adjacent the central opening 26 in the corrugation. The center 32 of the turbulator plate is smooth and, as previously indicated, solid to present a direct barrier to fluid flow. The size of the ribs 31 varies radially to conform to the divergent orientation of the wall sections 21 between which each turbulator plate is mounted. Thus, referring particularly to FIG. 2, the array of ribs in each plate is generally wave-shaped in cross section and defines a wave of increasing amplitude in a radial inward direction.

The outer surfaces of the wall sections 21 of each corrugation 20 are provided with a plurality of outwardly extending convex protrusions 33. The protrusions are relatively narrow and long and, in the preferred rectangular shape shown in FIG. 3, are positioned generally parallel to one another and perpendicular to the longer edges of the rectangular corrugation. Thus, for example, if the heat exchanger 10 of the present invention is utilized to remove heat from the engine coolant in an internal combustion engine, the cooling air flowing across the exterior of the heat exchanger will be caused to flow in the long direction of the rectangular shape and perpendicular to the convex protrusions 33. This assures an optimum flow of air over the greatest heat exchanging surface and the convex protrusions 33 are disposed to maximize air turbulence.

The walls 21 of each corrugation 20 may also be provided with a plurality of concave protrusions 34 which extend into the interior of the corrugation. The concave protrusions may be adapted to serve two separate and distinct purposes. First of all, the concave protrusions 34 enhance the heat exchanging surface area and provide interruptions which help create turbulence in the flow of fluid within the heat exchanger. In addition, concave protrusions extending inwardly from opposite wall sections 21 may be utilized to capture and hold in place the turbulator plate 27. As shown in FIG. 2, the concave protrusions 34 may be positioned to bear upon the crests of the ribs 31 as a pair of wall sections 21 are brought together and sealed along the continuous outer seam 24. Some separation must be maintained between the crests of the ribs and the inner surfaces of the wall sections 21, otherwise the flow of fluid therebetween would be restricted. The concave protrusions 34 thus also provide the requisite spacing. These inwardly extending protrusions may be dispersed between the outwardly extending convex protrusions 33 and of a substantially shorter length, as shown. Alternately, the concave protrusions 34 may be formed of generally the same length and alternately with the convex protrusions. If necessary, the contacting surfaces of the concave protrusions 34 and the crests of the ribs may be utilized to spot weld, braze or otherwise secure the parts together. However, because of the inwardly divergent shape of the wall sections 21 and the corresponding increase in the depth or amplitude of the wave-like ribs 31, the turbulator plates 27 are inherently captured and held in position between the wall sections as the latter are welded or otherwise secured together.

In lieu of utilizing concave protrusions 34 as a means of positioning and maintaining the spacing between the turbulator plate and the adjacent surfaces of the wall sections, the crests of certain of the turbulator ribs 31 may be provided with spaced upset portions 35 (see FIG. 2) which extend into contact with the inside surfaces of the wall sections 21. The small upset portions 35 may be formed in any convenient manner and, preferably, in the same stamping operation in which the ribs themselves are formed in the plates 27. If necessary or desirable, the upset portions 35 may also be utilized as brazing surfaces to positively attach the plates to the corrugation walls.

The heat exchanger 10 of the present invention may be made entirely of a stamped sheet metal construction. Both the corrugations 20 and the baffle or turbulator plates 27 may be made of thin sheets of steel or brass, for example, with a typical material thickness of 0.018–0.020 inches (0.46–0.51 mm). With appropriate tooling, the dish-shaped wall sections 21 including the outer and inner flanges 22 and 23 and convex and/or concave protrusions 33 and 34 may be stamped in a single step. The outer and inner seams 24 and 25 are preferably made by welding, but brazing and other methods may also be utilized. As compared to conventional automotive heat exchanger constructions, the present invention is advantageously distinguished by its elimination of soldered seams and connections which are known to be troublesome.

Figure 5:
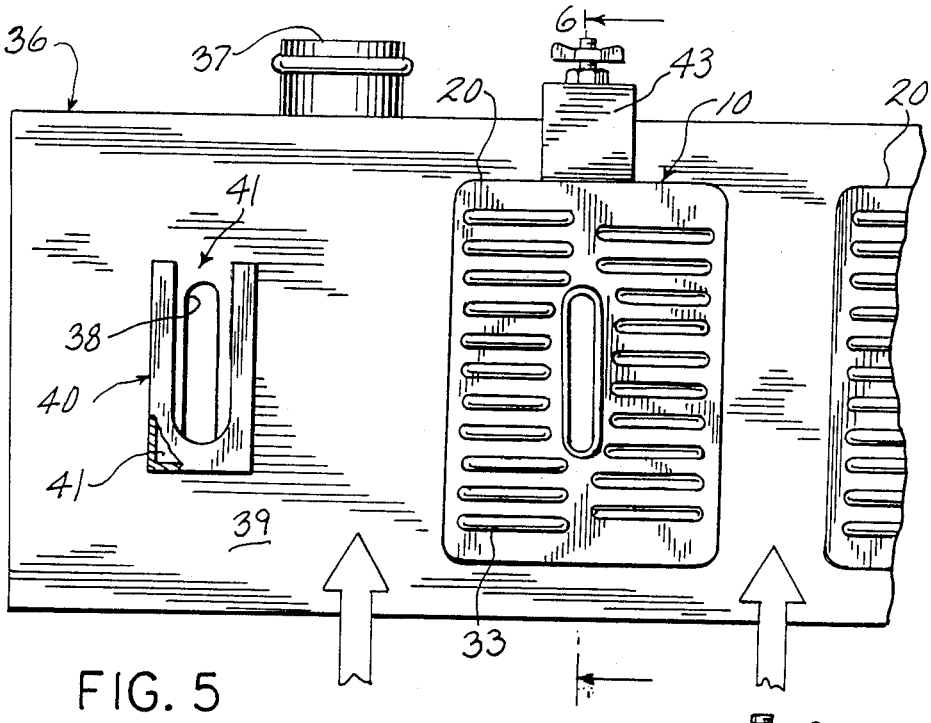
FIG. 5 is a bottom plan view of a common inlet tank showing details of the connection assembly for heat exchangers of the present invention.
Figure 6:
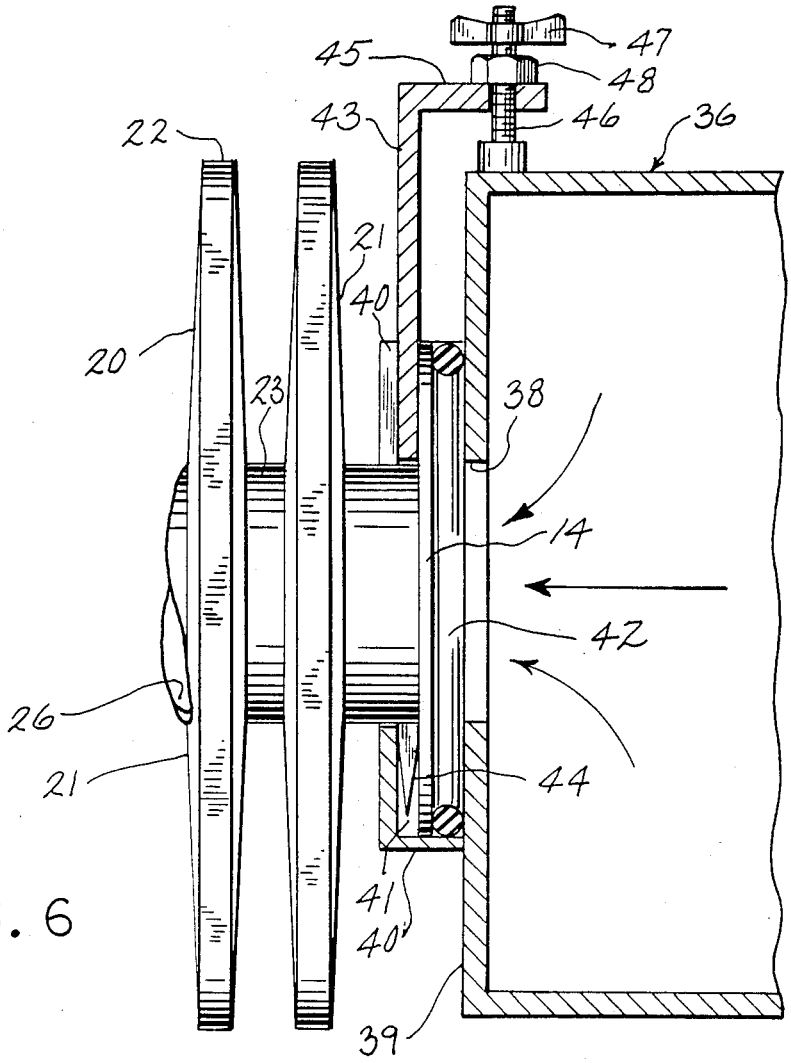
FIG. 6 is a sectional view of the heat exchanger taken on line 6—6 of FIG. 5.

Referring to FIGS. 5 and 6, there is shown an assembly for mounting a number of heat exchangers 10 of the present invention in a system for handling a flow of engine coolant. A similar system may, however, also be utilized for cooling (or heating) other liquids and/or gases. In place of an inlet header 15, as shown in FIG. 2, an inlet tank 36 is positioned above a parallel arrangement of heat exchangers 10. The inlet tank 36 includes a conventional inlet opening 37 for the attachment of a coolant supply hose or the like, such as from the water pump 11 (FIG. 1). The bottom surface 39 of the tank 36 includes a series of spaced outlet openings 38 which are elongated and of the same general shape as the central opening 26 through the heat exchanger conduit 18. A mounting bracket 40 is attached to the lower surface of the tank 36 surrounding each of the outlet openings 38. The mounting bracket 40 is of a U-shaped construction and of a shape corresponding to but slightly larger than the inner flange 23 of the first corrugation 20 attached to the inlet flange 14 of the heat exchanger conduit. The mounting bracket is mounted spaced from the surface of the tank and the open end of the U defines a slot 41 between the bracket and the bottom surface 39 of the tank into which the inlet flange and an appropriate sealing ring 42 may be slid into place such that the central opening 26 in the inlet flange 14 is in alignment with the outlet opening 38 in the bottom tank surface 39.

To secure the heat exchanger conduit in place and to press the inlet flange 14 and sealing ring 42 into sealing engagement with the surface of the tank surrounding the outlet opening 38, a wedge-shaped pressure plate 43 is inserted into the open end of the slot 41 between the inside surface of the mounting bracket 40 and the opposing face of the inlet flange 14. The pressure plate 43 has a bifurcated construction defined by a pair of spaced legs 44 which overlie the legs of the U-shaped slot 41 and, in a similar manner, surround the inner flange 23 defining the central opening 26 immediately adjacent the inlet flange 14. The wedging action of the pressure plate compresses the sealing ring 42 and secures the assembly together. The opposite end of the pressure plate 43 includes a mounting flange 45 having a threaded hole therein for receipt of a tightening screw 46 adapted to bear against the side wall of the inlet tank 36. The screw 46 may be rotated by hand with the integral wing nut 47 to establish the final position of the pressure plate 43 and the position maintained by tightening a lock nut 48 against the mounting flange 45.

The assembly for mounting the heat exchanger conduits to the supply tank is simple and effective, yet allows individual heat exchanger units to be replaced if necessary without the need to break and remake a soldered connection, as is necessary in conventional automotive radiator constructions. The outlet flange 16 of each heat exchanger unit may be similarly attached to a common outlet header (not shown) for the several tubular conduits in a manner identical to the inlet end. As indicated previously, each of the tubular conduits 18 of a preferred rectangular shape is oriented in the direction of flow of the cooling air past the unit, as indicated the large arrows in FIG. 5. This orientation provides optimized air turbulence and heat transfer.

Various modes of carrying out the present invention are contemplated as being within the scope of the following claims particularly pointing out and distinctly claiming the subject matter which is regarded as this invention.

I claim:

1. A heat exchanger for a fluid flow comprising:

a tubular conduit having a fluid inlet end and a fluid outlet end;

said conduit having a corrugated wall including a series of generally parallel, axially spaced corrugations, each of said corrugations comprising a pair of opposed dish-shaped wall sections joined at the outer edges thereof and having central openings defined by inner edge portions;

each of said inner edge portions joined to the inner edge portion of the wall section of an adjacent corrugation;

the surfaces of the wall sections of each corrugation diverging radially inwardly;

a turbulator plate mounted within each corrugation, each plate positioned between the central openings of the corrugation and having an outer peripheral edge spaced radially inwardly from the outer edges of the wall sections to define a peripheral fluid flow passage through the corrugation;

a series of tubulator ribs formed in each turbulator plate and extending generally normal to the direction of fluid flow over the plate;

positioning means including regions displaced out of one of the turbulator plate surface and the wall section surfaces of each corrugation and contacting the other of said plate surface and section surfaces for maintaining the turbulator plate centered radially within the corrugation and substantially equal spacing between the turbulator plate and the adjacent surfaces of the wall sections;

said series of ribs comprising a concentric array of ribs extending radially between the outer peripheral edge of said plate and the region of said plate adjacent the central openings in said wall sections; and, said array of ribs being generally wave-shaped in cross section and defining a wave of increasing amplitude in a radial inward direction from said outer peripheral edge.

2. The apparatus as set forth in claim 1 comprising a plurality of elongate convex protrusions formed in the outer surfaces of said wall sections.

3. The apparatus as set forth in claim 2 wherein said convex protrusions are positioned generally parallel to one another.

4. The apparatus as set forth in claim 1 wherein said positioning means comprises a plurality of concave protrusions formed in the outer surfaces of said wall sections and extending into said corrugations.

5. The apparatus as set forth in claim 4 wherein said concave protrusions extend into contact with said turbulator ribs.

6. The apparatus as set forth in claim 1 wherein said turbulator ribs extend axially in both directions from the plane of said turbulator plate.

7. The apparatus as set forth in claim 3 wherein said corrugations and turbulator plates are generally rectangular in a plane normal to the axis thereof.

8. A heat exchanger for a fluid flow comprising:

a tubular conduit having a fluid inlet end and a fluid outlet end;

said conduit having a corrugated wall including a series of generally parallel, axially spaced corrugations, each of said corrugations comprising a pair of opposed dish-shaped wall sections joined at the outer edges thereof and having central openings defined by inner edge portions;

each of said inner edge portions joined to the inner edge portion of the wall section of an adjacent corrugation;

the surfaces of the wall sections of each corrugation diverging radially inwardly;

a plurality of elongate parallel convex protrusions formed in the outer surfaces of said wall sections;

a turbulator plate mounted within each corrugation, each plate positioned between the central openings of the corrugation and having an outer peripheral edge spaced radially inwardly from the outer edges of the wall sections to define a peripheral fluid flow passage through the corrugation;

a series of turbulator ribs formed in each turbulator plate and extending generally normal to the direction of fluid flow over the plate;

positioning means for maintaining the spacing between the turbulator plate and the adjacent surfaces of the wall sections and for holding said plate in position;

wherein said corrugations and turbulator plates are generally rectangular in a plane normal to the axis thereof, said rectangular corrugations each including a pair of opposite longer edges; and wherein said convex protrusions are positioned generally perpendicular to the longer edges of said corrugations.

9. The apparatus as set forth in claim 8 wherein the central openings are elongated in the direction of the longer edges of said corrugations.

10. A heat exchanger for a fluid flow comprising:

a plurality of tubular conduits each having a fluid inlet end and a fluid outlet end;

each of said conduits having a corrugated wall including a series of generally parallel, axially spaced corrugations, each of said corrugations comprising a pair of opposed dish-shaped wall sections joined at the outer edges thereof and having central openings defined by inner edge portions;

each of said inner edge portions joined to the inner edge portion of the wall section of an adjacent corrugation;

the surfaces of the wall sections of each corrugation diverging radially inwardly;

a turbulator plate mounted within each corrugation, each plate positioned between the central openings of the corrugation and having an outer peripheral edge spaced radially inwardly from the outer edges of the wall sections to define a peripheral fluid flow passage through the corrugation;

a series of turbulator ribs formed in each turbulator plate and extending generally normal to the direction of fluid flow over the plate;

positioning means including regions displaced out of one of the turbulator plate surface and the wall section surfaces of each corrugation and contacting the other of said plate surface and section surfaces for maintaining the turbulator plate centered radially within the corrugation and substantially equal spacing between the turbulator plate and the adjacent surfaces of the wall sections;

each of said tubular conduits having an inlet flange and an outlet flange attached respectively to the inlet and outlet ends;

a common fluid supply header having outlet openings therein for supplying fluid to each of said tubular conduits;

a common fluid outlet header having inlet openings therein for receiving fluid from each of said tubular conduits;

a compressible seal positioned between each inlet flange and the surface of the supply header surrounding the outlet opening therein and each outlet flange and the surface of the outlet header surrounding the inlet opening therein;

demountable connection means for each inlet flange and outlet opening and each outlet flange and inlet opening for providing fluid-tight connections therebetween; and, said demountable connection means comprising a U-shaped mounting bracket attached to the header and in alignment with one of the openings therein, said mounting bracket defining with the surface of the header a mounting slot dimensioned to receive the flange and compressible seal on one end of one of said tubular conduits, and a pressure plate insertable between said bracket and said flange to compress the seal and secure the conduit to the header.

* * * * *